US009593602B2

(12) United States Patent
Neukirchner et al.

(10) Patent No.: US 9,593,602 B2
(45) Date of Patent: Mar. 14, 2017

(54) DEVICE FOR A VALVE TRAIN FOR SWITCHING OVER THE LIFT OF GAS-EXCHANGE VALVES OF AN INTERNAL COMBUSTION ENGINE

(71) Applicant: IAV GMBH Ingenieurgesellschaft Auto und Verkehr, Berlin (DE)

(72) Inventors: Heiko Neukirchner, Chemnitz (DE); Andreas Werler, Zwickau (DE); Uwe Richter, Chemnitz (DE)

(73) Assignee: IAV GMBH INGENIEURGESELLSCHAFT AUTO UND VERKEHR, Berlin (DE)

( * ) Notice: Subject to any disclaimer, the term of this patent is extended or adjusted under 35 U.S.C. 154(b) by 0 days.

(21) Appl. No.: 14/876,839

(22) Filed: Oct. 7, 2015

(65) Prior Publication Data

US 2016/0097306 A1 Apr. 7, 2016

(30) Foreign Application Priority Data

Oct. 7, 2014 (DE) ..... 10 2014 014 599

(51) Int. Cl.
*F01L 1/02* (2006.01)
*F01L 1/26* (2006.01)
*F01L 1/047* (2006.01)

(52) U.S. Cl.
CPC ..... *F01L 1/267* (2013.01); *F01L 1/047* (2013.01)

(58) Field of Classification Search
CPC ..... F01L 1/267; F01L 1/047
USPC ..... 123/90.27
See application file for complete search history.

(56) References Cited

U.S. PATENT DOCUMENTS

| | | | | |
|---|---|---|---|---|
| 8,225,759 | B2 | 7/2012 | Wutzler et al. | |
| 8,347,837 | B2 | 1/2013 | Meintschel et al. | |
| 2007/0204819 | A1* | 9/2007 | Elendt | F01L 1/053 123/90.16 |
| 2012/0291731 | A1 | 11/2012 | Parsche | |

FOREIGN PATENT DOCUMENTS

| | | | |
|---|---|---|---|
| DE | 10148177 | A1 | 4/2003 |
| DE | 102007056692 | A1 | 5/2009 |
| DE | 102007061353 | A1 | 6/2009 |
| DE | 102009039733 | A1 | 3/2011 |

(Continued)

*Primary Examiner* — Zelalem Eshete
(74) *Attorney, Agent, or Firm* — Leydig, Voit & Mayer, Ltd.

(57) ABSTRACT

A device for a valve train for switching over the lift of gas-exchange valves of an internal combustion engine comprising a camshaft on which at least one cam carrier with at least three different cam profiles is mounted so as to be non-rotatable and axially movable. The device includes an adjustment shaft arranged parallel to the camshaft and on which a first transmission element is mounted so as to be non-rotatable and axially movable, the first transmission element having a guide unit, a housing-fixed first guide element operatively connected to the guide unit, a second guide element operatively connected, on the one hand, to the guide unit and, on the other hand, to the cam carrier via a second transmission element, the second transmission element being connected to the cam carrier so as to be axially unmovable, and a push element operatively connected to the first transmission element.

3 Claims, 2 Drawing Sheets

(56) References Cited

FOREIGN PATENT DOCUMENTS

| | | | |
|---|---|---|---|
| DE | 102009057691 | A1 | 6/2011 |
| DE | 102011101868 | A1 | 11/2012 |
| DE | 102011101868 | B4 | 2/2013 |
| DE | 102012001303 | A1 | 7/2013 |
| WO | WO 2009065478 | A1 | 5/2009 |
| WO | WO 2011026562 | A1 | 3/2011 |
| WO | 102011115788 | A1 | 4/2013 |

* cited by examiner

DEVICE FOR A VALVE TRAIN FOR SWITCHING OVER THE LIFT OF GAS-EXCHANGE VALVES OF AN INTERNAL COMBUSTION ENGINE

CROSS REFERENCE TO RELATED APPLICATIONS

This application claims benefit to German Patent Application No. DE 10 2014 014 599.9, filed Oct. 7, 2014, which is incorporated by reference herein.

FIELD

The present invention relates to a device for a valve train for switching over the lift of gas-exchange valves of an internal combustion engine, comprising an adjustment shaft that runs parallel to a camshaft.

BACKGROUND

German preliminary published application DE 101 48 177 A1 discloses a valve train with a valve lift switchover for the gas-exchange valves. The valve train comprises cam pieces that are mounted non-rotatably and axially movably on a spline shaft and that have at least two adjacent cams with a different lift for each individual gas-exchange valve. Moreover, in order to move the cam pieces radially to the cam piece, movable housing-fixed actuators are provided that interact with movement grooves that are configured to be mirror-symmetrical and that intersect each other on the cam pieces, whereby each cam piece is provided with an actuator pin. For a reciprocal movement of the cam pieces, the actuator pin in question is brought into contact with a corresponding flank of the intersecting, and thus contiguous, movement grooves. This valve train is only suitable for a valve lift switchover between two adjacent cams. If more than two cams are to be switched over, a multiple arrangement of movement grooves and actuator pins is necessary. Moreover, since the movement grooves do not have a non-ambiguous course, switching inaccuracies can occur due to the actuator pins.

German preliminary published application DE 10 2007 056 692 A1 discloses a valve train device of an internal combustion engine with a valve lift switchover. Two switching sleeves that each have a link track and an actuator pin that can be brought into contact with the appertaining link track are provided for the valve train switchover of two axially movable cam elements, whereby a first switching sleeve causes the cam elements to move in a first switching direction, while a second switching sleeve causes the cam elements to move in a second switching direction. Accordingly, during a valve switchover, in the case of a first switching direction, the first switching sleeve is used to move the first cam element and to subsequently move the second cam element. In the case of a second switching direction, the second switching sleeve is used to move the first cam element and to subsequently move the second cam element. For this purpose, the link tracks of the switching sleeves are s-shaped and configured to be mirror-symmetrical to each other. This valve train is only suitable for a valve lift switchover between two adjacent cams. Furthermore, this valve train involves a great deal of production and assembly work as compared to other valve lift switchover systems.

German preliminary published application DE 10 2007 061 353 A1 discloses a valve train for gas-exchange valves of an internal combustion engine with a moveable cam carrier. The cam carrier is mounted on a camshaft so as to be non-rotatable but axially movable, and it has several cams at an axial distance that have different elevations and that are combined to form a cam group for the appertaining gas-exchange valve. An engagement element continuously engages with a continuous groove running along the circumference of the cam carrier, and this engagement element executes a lift in the axial direction corresponding to the course of the continuous groove. The engagement element can be locked in certain positions, as a result of which the cam carrier is forced to make an axial movement so that it switches over between the cams in order to drive a gas-exchange valve. However, the described system requires a great deal of installation space, meaning that it can only be used in internal combustion engines that have a sufficient distance between the cylinders. The engagement element has to be continuously carried along and there is a risk of greater wear and tear. Moreover, for each movable cam carrier, an actuator is needed in order to lock the engagement element, and this actuator has to be activated and then deactivated at the right point in time.

German preliminary published application DE 10 2009 039 733 A1 discloses a valve train for gas-exchange valves of an internal combustion engine in which a cam unit with several different cam tracks arranged adjacent to each other is mounted so as to be non-rotatable and axially movable on a camshaft. In order to switch over the lift of the gas-exchange valves, the cam unit can be moved axially by an adjustment means. The adjustment means comprises an adjustment element that is mounted so as to be movable inside the camshaft and that serves to transmit the adjustment movement to the cam unit. For this purpose, the circumference of the adjustment element has a track profile that cooperates with a coupling element, and moreover, the coupling element is connected to the cam unit by means of a recess in the camshaft. An axial movement of the cam unit on the camshaft is effectuated by a movement of the adjustment element relative to the camshaft. A variant embodiment describes that the adjustment element is rotatably mounted in the camshaft and that the track profile extends essentially in the circumferential direction of the adjustment element. The change between two cam tracks on the cam unit for the actuation of the gas-exchange valves is effectuated by an axial offset in the track profile that results from a rotation of the adjustment element relative to the camshaft. Due to a rotation relative to the camshaft, more effort is required in order to switch forward and backward between the different cam tracks by means of a reversal of the direction of rotation of the adjustment element. Moreover, high stresses arise as a result of the requisite axial rise in the track profile.

German patent DE 10 2011 101 868 B4 discloses a device for a valve lift switchover. For this purpose, a cam carrier is arranged axially movably on a camshaft, and different cam profiles are made on the cam carrier in order to establish an operative connection to an associated charge-exchange valve. In order to axially move the cam carrier, an adjustment shaft is provided parallel to the camshaft, and a first transmission element is arranged on the adjustment shaft so as to be non-rotatable and axially movable. The first transmission element has a guide track along which a housing-fixed first engagement element and additionally a second engagement element of a second transmission element run when the adjustment shaft is rotated. The second transmission element is connected to the cam carrier in such a way that the cam carrier is moved axially when the adjustment shaft is rotated. This device for the valve lift switchover can be used for more than two different cam profiles, whereby only a sequential switchover between the different cam profiles is possible.

SUMMARY

According to an embodiment, a device is provided for a valve train for switching over the lift of gas-exchange valves of an internal combustion engine comprising a camshaft on which at least one cam carrier with at least three different cam profiles is mounted so as to be non-rotatable and axially movable. The device includes an adjustment shaft arranged parallel to the camshaft and on which a first transmission element is mounted so as to be non-rotatable and axially movable, the first transmission element having a guide unit, a housing-fixed first guide element operatively connected to the guide unit, a second guide element operatively connected, on the one hand, to the guide unit and, on the other hand, to the cam carrier via a second transmission element, the second transmission element being connected to the cam carrier so as to be axially unmovable, and a push element operatively connected to the first transmission element. The guide unit includes a first guide track and a second guide track arranged axially at a distance from the first guide track. The guide unit includes at least four connecting tracks that are disposed between the first guide track and the second guide track and that are at a distance from each other along a circumference of the first transmission unit. The first guide element and the second guide element run at least one of: along the first guide track for purposes of forward switching, along the second guide track for purposes of backward switching, or along one of the at least four connecting tracks to effectuate a change between forward switching and backward switching. The push element is operative to effectuate an axial movement of the first transmission element relative to the first guide element and to the second guide element when the first guide element and the second guide element each run along one of the connecting tracks.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DESCRIPTION OF THE INVENTION

Figure 1:
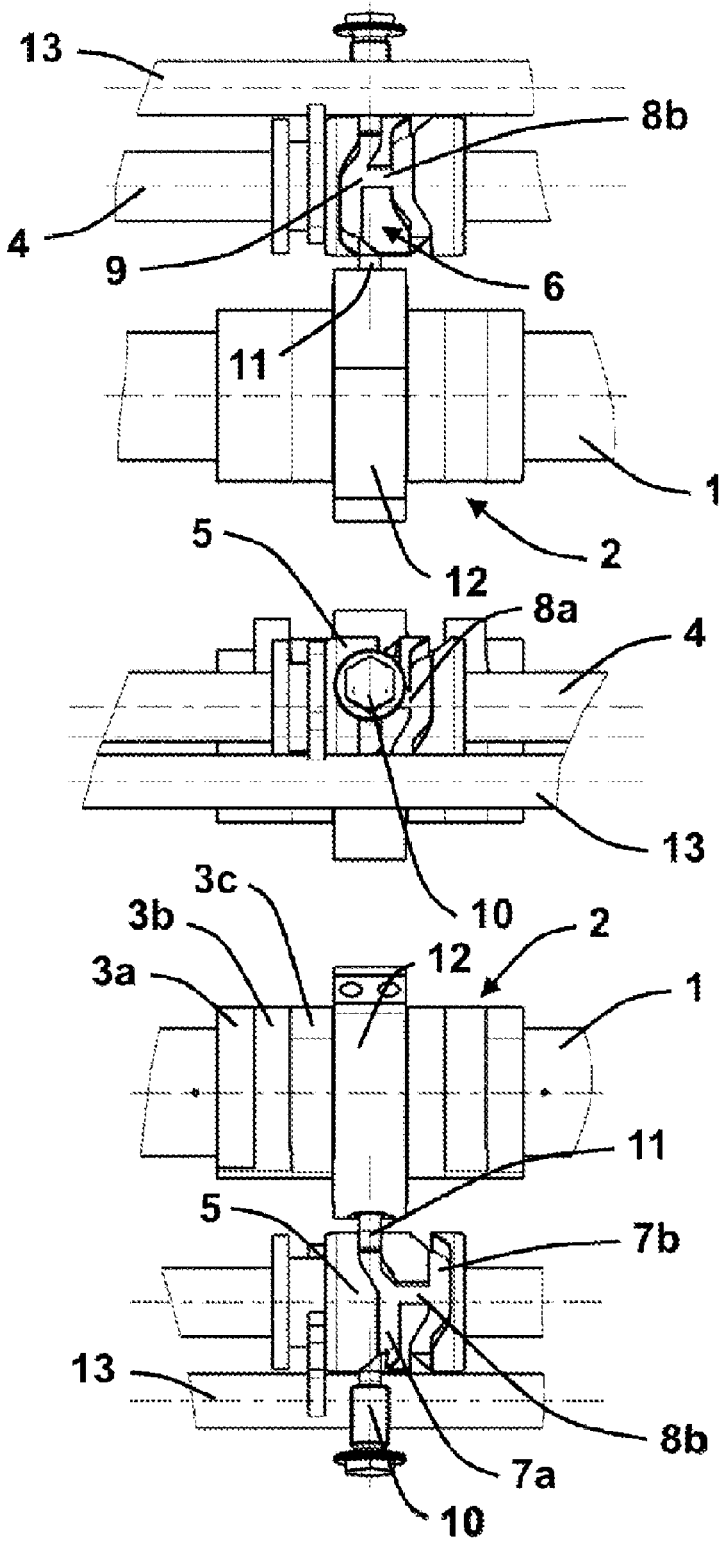
FIG. 1 provides schematic depictions of side views of a device according to an embodiment of the invention, and FIG. 2 provides schematic depictions of perspective views of a device according to an embodiment of the invention.

Valve train devices are already known that have a mechanism for switching over the lift of gas-exchange valves. The invention is based on a valve train in which the gas-exchange valves of an internal combustion engine are actuated by means of a camshaft directly or indirectly via transmission means during the operation of the internal combustion engine. In order to switch over the valve lift, adjacent cams with different cam shapes are provided on the camshaft and these are combined to form a cam unit. Due to an axial movement of the cam units on the camshaft relative to the gas-exchange valves, each cam of the cam group is made to engage with the corresponding gas-exchange valve, and the lift of the gas-exchange valves is generated as a function of the cam shape. In order to move the cam units, actuators can act directly on the cam units or else an adjustment shaft is provided that runs parallel to the camshaft and that has corresponding elements for engagement with the cam units. Here, especially movement grooves with an axial offset are used so that, in conjunction with housing-fixed actuators, a rotational movement can be converted into an axial movement.

An embodiment of the invention provides an improved device for a valve train for switching over the lift of gas-exchange valves of an internal combustion engine, in which the technical effort and the stresses are reduced.

An embodiment of the invention puts forward a particularly advantageous device for a valve train for switching over the lift of gas-exchange valves of an internal combustion engine, with which an at least three-stage lift switchover with forward and back capabilities can be effectuated, thereby reducing the technical effort involved in the capability to switch back and also reducing the loads in the switchover device. In an especially advantageous manner, the valve lift of gas-exchange valves can be varied, whereby, in contrast to conventional, sequentially operable switchover devices with the capability to switch back, the possibility presented here for a cycle-accurate and ignition sequence-accurate valve lift switchover results in a faster adaptation of the lift of gas-exchange valves to the operation of the internal combustion engine.

The device according to an embodiment of the invention comprises a camshaft on which at least one cam carrier with at least three different cam profiles is mounted so as to be non-rotatable and axially movable. The camshaft is mounted in a housing, especially in a cylinder head, and it is intended to actuate the gas-exchange valves, whereby a cam carrier is associated with a gas-exchange valve, and one of the at least three cam profiles of the cam carrier is operatively connected to the associated gas-exchange valve for purposes of direct actuation, or else via lever arms for purposes of indirect actuation. Furthermore, an adjustment shaft is provided which is arranged parallel to the camshaft and on which a first transmission element is arranged so as to be non-rotatable and axially movable. The first transmission element has a guide unit. Moreover, a housing-fixed first guide element is provided that is operatively connected to the guide unit. Moreover, a second guide element is provided that is operatively connected, on the one hand, to the guide unit and, on the other hand, to the cam carrier via a second transmission element. For this purpose, the second transmission element is connected to the cam carrier so as to be axially unmovable, so that the cam carrier can be axially moved together with the second transmission element. An at least three-stage lift switchover for gas-exchange valves results from the arrangement comprising the housing-fixed first guide element, the first transmission element with the guide unit, the second guide element with the second transmission element, and the cam carrier.

A lift switchover is effectuated by rotating the adjustment shaft, whereby the first transmission element is moved axially and the rotation of the first transmission element vis-à-vis the housing is assisted by the first guide element. The rotation of the first transmission element is converted into an axial offset of the first transmission element by means of the guide unit. The axial movement and rotation of the first transmission element are also transmitted further as an axial movement to the cam carrier via the second guide element with the second transmission element, whereby the axial movement and rotation of the first transmission element are converted into an axial offset of the cam carrier by means of the guide unit. The lift switchover takes place when the operative connection between the appertaining cam profile and the gas-exchange valve is situated in the area of the base circle of the cam profile.

Advantageously according to an embodiment of the invention, the guide unit has a first guide track as well as a second guide track that is arranged axially at a distance from the first guide track, as well as at least four connecting tracks that are between the first guide track and the second guide track and that are at a distance from each other along the circumference of the first transmission unit. The first guide element and the second guide element run along the first guide track, along the second guide track or along one of the connecting tracks. The first guide track runs along the circumference and is configured as a closed guide track of the first transmission element, which is configured as a sleeve, whereby each first guide track has a transition piece leading to one of the at least four connecting tracks. The second guide track is configured as a guide track that is interrupted along the circumference of the first transmission element, whereby at least two guide track segments that are separate from each other are each connected to two connecting tracks. As an alternative, the second guide track runs along the circumference and is also configured as a closed guide track of the first transmission element, whereby each guide track has a transition piece leading to one of the at least four connecting tracks. The first guide track is provided as a forward-switching track, while the second guide track is provided as a backward-switching track between the at least three different cam profiles. The forward-switching track and the backward-switching track are determined by a switching sequence of a sequential, rolling switchover between the at least three cam profiles, whereby the switching positions of the forward-switching track are shifted relative to the switching positions of the backward-switching track along the circumference of the first transmission element as a function of the cycle-correct and ignition sequence-correct switchover for internal combustion engines having a multi-cylinder arrangement. The first guide track and the second guide track have steps in the axial direction corresponding to the number of switching positions. Moreover, it is necessary to rotate the adjustment shaft between two switching positions, depending on the number of switching positions.

This results in an operative connection of the housing-fixed first guide element via the first transmission element and the second transmission element to the cam carrier, whereby the first guide element and the second guide element run together, either along the first guide track or along the second guide track.

Moreover, a push element is provided that is operatively connected to the first transmission element in order to effectuate an axial movement of the first transmission element relative to the first guide element and to the second guide element when the first guide element and the second guide element each run along one of the connecting tracks. The axial movement of the first transmission element by means of the push element can be initiated when the first guide element and the second guide element run along the first guide track or the second guide track in the area of the transition piece leading to one of the four connecting tracks. In this context, the connecting tracks are arranged along the circumference of the first transmission element and are offset relative to each other so as to correspond to the offset between the first guide element and the second guide element in such a way that, while the first transmission element is being moved by the push element, the first guide element and the second guide element run simultaneously along one of the connecting tracks.

Due to the axial movement of the first transmission element by means of the push element, the first guide element and the second guide element are moved along one of the connecting tracks and are transferred from the first guide track to the second guide track or from the second guide track to the first guide track.

Advantageously according to an embodiment of the invention, at least two of the at least four connecting tracks are configured to transfer the first guide element and the second guide element from the first guide track to the second guide track, and at least two other of the at least four connecting tracks are configured to transfer the first guide element and the second guide element from the second guide track to the first guide track.

In this manner, a three-stage lift switchover with a forward-switching and backward-switching capability is effectuated, whereby, for purposes of forward switching, the adjustment shaft is rotated in a forward-switching direction of rotation while, for purposes of backward switching, the adjustment shaft is rotated in a backward-switching direction of rotation that is opposite from the forward switching direction. Consequently, the adjustment shaft is operatively connected to a means for reversing the direction of rotation. The first guide element and the second guide element run along the first guide track during the forward switching, and they run along the second guide track during the backward switching, whereby, in the case of a change from forward switching to backward switching, as a result of the axial movement of the first transmission element by means of the push element, the first guide element and the second guide element each run along one of the connecting tracks in order to be transferred from the first guide track to the second guide track and, in case of a change from backward switching to forward switching, they each run along one of the connecting tracks in order to be transferred from the second guide track to the first guide track.

In case of a complete rotation of the first transmission element in the forward-switching direction, the following consecutive switching positions apply for the first guide track with the first switching sequence: first, second, third, second and first switching position. In case of backward switching, the transfer of the first guide element and of the second guide element from the first guide track to the second guide track takes place during the second switching position, so that, starting from the second switching position that follows the first switching position, on the basis of the first switching sequence, it is possible to switch back to the first switching position, or else, starting from the second switching position that follows the third switching position, on the basis of the first switching sequence, it is possible to switch back to the third switching position.

In an especially advantageous manner, a first cam profile can be configured as a zero-stroke cam in order to effectuate a switch-off of the gas-exchange valve. A second cam profile is configured as a full-stroke cam for a maximum possible lift of the gas-exchange valve, and furthermore, a third cam profile is configured as a partial-stroke cam for a lift of the gas-exchange valve between the maximum lift and the switch-off of the gas-exchange valve. Depending on the operating state of the internal combustion engine, one cam profile of the three different cam profiles is brought into operative connection with the associated gas-exchange valve.

Here, in an advantageous manner, the first cam profile with the zero-stroke cam is associated with the first switching position, the second cam profile with the full-stroke cam is associated with the second switching position, and the third cam profile with the partial-stroke cam is associated with the third switching position. For a multi-cylinder arrangement, there are multiple devices according to the invention for a valve train for switching over the lift of gas-exchange valves of an internal combustion engine, whereby each gas-exchange valve is associated with one device. The push element is then configured as a push rod and it is operatively connected to each device of the gas-exchange valve in question.

Figure 2:
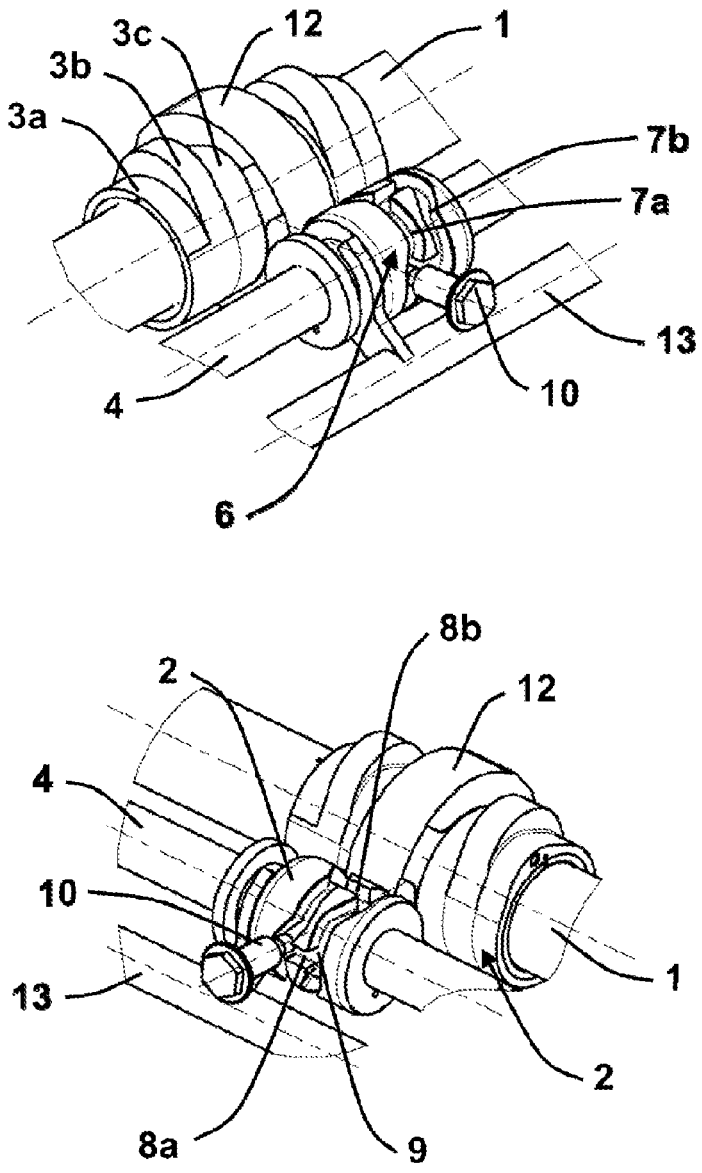

The embodiment shown in FIGS. 1 and 2 comprises a camshaft 1 on which at least one cam carrier 2 with at least three different cam profiles 3*a*, 3*b*, 3*c* is mounted so as to be non-rotatable and axially movable. An adjustment shaft 4 is provided which is arranged parallel to the camshaft 1 and on which a first transmission element 5 is arranged so as to be non-rotatable and axially movable. The first transmission element 5 has a guide unit 6. The guide unit 6 has a first guide track 7*a* for purposes of forward switching and a second guide track 7*b* for purposes of backward switching that is arranged axially at a distance from the first guide track 7*a*, and it also has four connecting tracks 8*a*, 8*b* between the first guide track 7*a* and the second guide track 7*b* that are at a distance from each other along the circumference of the first transmission unit 5. The guide tracks 7*a*, 7*b* are configured as closed guide tracks 7*a*, 7*b* running along the circumference with a three-step configuration in the axial direction, whereby the guide tracks 7*a*, 7*b* each have a transition piece 9 leading to one of the four connecting tracks 8*a*, 8*b*.

Moreover, a housing-fixed first guide element 10 and a second guide element 11 are provided that run along the first guide track 7*a*, along the second guide track 7*b*, or along one of the connecting tracks 8*a*, 8*b*. The first guide element 10 and the second guide element 11 run along the first guide track 7*a* during the forward switching or along the second guide track 7*b* during the backward switching.

The second guide element 11 is operatively connected to the cam carrier 2 by means of a second transmission element 12. The second transmission element 12 is connected to the cam carrier 2 so as to be axially unmovable, so that the cam carrier 2 can be moved together with the second transmission element 12.

Moreover, a push element 13 is provided that is operatively connected to the first transmission element 5 in order to effectuate an axial movement of the first transmission element 5 relative to the first guide element 10 and to the second guide element 11 when the first guide element 10 and the second guide element 11 each run along one of the connecting tracks 8*a*, 8*b*. For this purpose, the two first connecting tracks 8*a* are configured to transfer the first guide element 10 and the second guide element 11 from the first guide track 7*a* to the second guide track 7*b*, and two second connecting tracks 8*b* are configured to transfer the first guide element 10 and the second guide element 11 from the second guide track 7*b* to the first guide track 7*a*.

In this context, the first connecting tracks 8*a* and the second connecting tracks 8*b* are arranged offset relative to each other along the circumference of the first transmission element 5, corresponding to the offset between the first guide element 10 and the second guide element 11, so that, while the first transmission element 5 is being moved by the push element 13, in case of a change from forward switching to backward switching, the first guide element 10 and the second guide element 11 each run along one of the first connecting tracks 8*a* or, in case of a change from backward switching to forward switching, they each run along one of the second connecting tracks 8*b*.

The adjustment shaft 4 is operatively connected to a means for reversing the direction of rotation (not shown) in order to rotate the adjustment shaft 4 in a forward-switching direction of rotation in case of forward switching, and in a backward-switching direction of rotation that is opposite to the forward-switching direction of rotation in case of backward switching.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

LIST OF THE REFERENCE NUMERALS EMPLOYED

1 camshaft
2 cam carrier
3*a*, 3*b*, 3*c* cam profile
4 adjustment shaft
5 first transmission element
6 guide unit
7*a*, 7*b* first guide track, second guide track
8*a*, 8*b* first connecting tracks, second connecting tracks
9 transition piece
10 first guide element
11 second guide element
12 second transmission element
13 push element

The invention claimed is:

1. A device for a valve train for switching over the lift of gas-exchange valves of an internal combustion engine comprising a camshaft on which at least one cam carrier with at least three different cam profiles is mounted so as to be non-rotatable and axially movable, the device comprising:

an adjustment shaft arranged parallel to the camshaft and on which a first transmission element is mounted so as to be non-rotatable and axially movable, the first transmission element having a guide unit, a housing-fixed first guide element operatively connected to the guide unit, a second guide element operatively connected, on the one hand, to the guide unit and, on the other hand, to the cam carrier via a second transmission element, the second transmission element being connected to the cam carrier so as to be axially unmovable, and a push element operatively connected to the first transmission element, wherein the guide unit includes a first guide track and a second guide track arranged axially at a distance from the first guide track, wherein the guide unit includes at least four connecting tracks that are disposed between the first guide track and the second guide track and that are at a distance from each other along a circumference of the first transmission unit, wherein the first guide element and the second guide element run at least one of:

along the first guide track for purposes of forward switching, along the second guide track for purposes of backward switching, or along one of the at least four connecting tracks to effectuate a change between forward switching and backward switching, and wherein the push element is operative to effectuate an axial movement of the first transmission element relative to the first guide element and to the second guide element when the first guide element and the second guide element each run along one of the connecting tracks.

2. The device for a valve train according to claim 1, wherein, for purposes of forward switching, the adjustment shaft is operatively connected to a reverser configured to reverse the direction of rotation in order to rotate the adjustment shaft in a forward-switching direction of rotation while, for purposes of backward switching, the adjustment shaft is rotated in a backward-switching direction of rotation that is opposite from the forward switching direction.

3. The device for a valve train according to claim 1, wherein first connecting tracks and second connecting tracks, are arranged offset relative to each other along the circumference of the first transmission element, corresponding to the offset between the first guide element and the second guide element, so that, while the first transmission element is being moved by the push element, in case of a change from forward switching to backward switching, the first guide element and the second guide element each run along one of the first connecting tracks or, in case of a change from backward switching to forward switching, the first guide element and the second guide element each run along one of the second connecting tracks.

* * * * *